US005454548A

United States Patent [19]

Moore

[11] Patent Number: 5,454,548

[45] Date of Patent: Oct. 3, 1995

[54] MODULAR METAL FENCING AND GRATINGS EMPLOYING NOVEL FASTENING MEANS FOR REDUCTION OF ASSEMBLY TIME

[76] Inventor: Robert S. Moore, 5070 Calle La Vela, Tucson, Ariz. 85714

[21] Appl. No.: 202,163

[22] Filed: Feb. 25, 1994

[51] Int. Cl.[6] ..... E04H 17/16; E06B 9/01

[52] U.S. Cl. ..... 256/22; 256/65; 256/59; 49/50; 52/667; 52/664

[58] Field of Search ..... 256/22, 24, 65, 256/59, 21; 403/243, 263, 264; 52/106, 664, 666, 667, 668; 49/50–57

[56] References Cited

U.S. PATENT DOCUMENTS

| | | | |
|---|---|---|---|
| 262,448 | 8/1882 | Maunder . | |
| 626,733 | 6/1899 | Stewart . | |
| 791,327 | 5/1905 | Dale . | |
| 1,109,613 | 9/1914 | Canada | 52/668 X |
| 1,376,150 | 4/1921 | Miller | 256/21 X |
| 1,963,981 | 6/1934 | Garrett . | |
| 3,724,865 | 4/1973 | Cristie . | |
| 3,724,884 | 4/1973 | Roider . | |
| 3,849,008 | 11/1974 | Boucher et al. . | |
| 4,435,103 | 3/1984 | Beckert et al. . | |
| 4,474,299 | 10/1984 | Andrews . | |
| 4,667,935 | 5/1987 | Moore . | |
| 4,883,256 | 11/1989 | Hebda | 256/22 |
| 4,986,513 | 1/1991 | Schultz et al. | 256/22 X |
| 5,150,885 | 9/1992 | Leone | 256/22 |
| 5,192,054 | 3/1993 | Sharp | 256/24 |

FOREIGN PATENT DOCUMENTS

| | | |
|---|---|---|
| 1056736 | 3/1954 | France . |

*Primary Examiner*—Anthony Knight

[57] ABSTRACT

A method for joining tubular members at right angles for use in the construction of a rail and pole metal fence or grating, in which the poles are inserted through pre-punched multi-sided clearance holes in the rails and are secured in the clearance holes by a coupling bar that engages slots in the slides of the poles as it is inserted longitudinally inside the rail.

4 Claims, 2 Drawing Sheets

MODULAR METAL FENCING AND GRATINGS EMPLOYING NOVEL FASTENING MEANS FOR REDUCTION OF ASSEMBLY TIME

BACKGROUND OF THE INVENTION

Fences utilizing metal pickets or poles have been popular for many years, and are strong, durable and attractive, requiring little or no maintenance. Wrought iron fences have become especially popular in recent times as protective fencing around swimming pools, gardens and serve as security barriers around patios and entryways. Similar decorative barriers have been employed as protective grates over the windows of homes and other structures.

Wrought iron fences are typically welded together, and are usually constructed and installed by professional artisans. For this reason, they are relatively expensive.

If the merits of iron fencing are to be enjoyed by a broader segment of the population, a simpler construction method must first be found utilizing procedures that are within the skills of the ordinary handyman or "do-it-yourself" nonprofessional person. A less expensive construction is also essential in terms of the cost of manufactured parts. Such reduced costs can be achieved through the employment of modular parts and low assembly labor.

The present invention is directed toward new and improved apparatus which may be employed in the construction of metal grating and fencing, and a novel method for interconnecting modular tubular metallic members into similar structures and assemblies.

DESCRIPTION OF THE PRIOR ART

Interconnection of tubular members is described in the following prior art.

French Patent No. 1,056,736 discloses a round bar or lever passing through a hole extending laterally through the enlarged end of a shaft and secured therein by a set screw.

U.S. Pat. No. 3,724,884 discloses a set screw with serrations for penetrating a rod, the screw securing a round shaft concentrically mounted inside a hub.

U.S. Pat. Nos. 262,448; 791,327; 626,733; 1,963,981; 4,435,103; 3,724,865; 3,849,008 and 4,474,299 disclose interconnecting tubular or solid members through the use of set screws or other fasteners.

In U.S. Pat. Nos. 3,724,865 and 3,849,008, set screws are employed to secure the joining of two tubular or solid members that are coaxially arranged with the smaller of the two being inserted into the end of the larger. The remaining above identified patents employ additional fittings at the joint with a set screw or other fastener employed to secure the coupling of the fitting to the tubular member or members. U.S. Pat. No. 791,327 employs the set screw to secure the mounting of a shaft or blade to a tubular member, the blade being passed through a slit in the tubular member.

U.S. Pat. No. 4,667,935, issued to the present inventor, discloses a method for joining tubular members at right angles for use in the construction of a rail and pole metal fence, grating and the like, in which the poles are inserted in pre-punched multi-sided clearance holes in the rails and are secured therein by means of set screws, serrated pins or nails.

SUMMARY OF THE INVENTION

In accordance with the invention claimed, new and improved parts and method of assembly are provided for the construction of metal fence and grating panels, employing the joining together at right angles two square or rectangular tubular members of different cross-sectional dimensions. The joint is made by passing the smaller member through a square or rectangular clearance hole in the larger member and securing the two members together through the engagement of a slot in the smaller member and a coupling bar that is inserted lengthwise inside the larger member during assembly.

It is, therefore, one object of this invention to provide a new fence assembly.

Another object of this invention is to provide a novel grate and fence construction in a form that may be readily assembled from a set of component parts by a handyman of ordinary skill and experience without the use of welding equipment or other special tools.

A further object of this invention is to provide a method for joining at right angles two tubular metal members of different cross-sectional dimensions.

A still further object of this invention is to provide such a joining method that requires no screws or pins for securing the joints between poles and rails.

A still further object of this invention is to provide such a fence construction that may be assembled from a kit of a minimum number of parts.

A still further object of this invention is to provide in such a fence construction a high degree of modularity such that an appropriate quantity of standard components may be employed to build a grate, fence or enclosure of any desired dimensions.

A still further object of this invention is to provide such a modular fence construction in which the manufactured components are reduced to a small number of very simple and inexpensive parts.

A still further object of this invention is to provide a collection of tubular parts that may be assembled in a novel manner to form fence parts, protective and decorative grates and screens for use over windows, around patios, entryways and the like.

Yet another object of this invention is to provide a fence or grate construction that rivals or equals wrought iron in beauty and utility and may be produced at a considerably lower cost.

Further objects and advantages of this invention will become apparent as the following description proceeds, and the features of novelty which characterize the invention will be pointed out with particularity in the claims annexed to and forming a part of this specification.

BRIEF DESCRIPTION OF THE DRAWINGS

The present invention may be more readily described with reference to the accompanying drawing, in which.

DESCRIPTION OF THE PREFERRED EMBODIMENT

Referring more particularly to the drawings by characters of reference, FIGS. 1–7 disclose a decorative metal panel 10 for grate or fence use and associated parts and accessories and are illustrative of the method of assembly embodying the invention.

Figure 1:
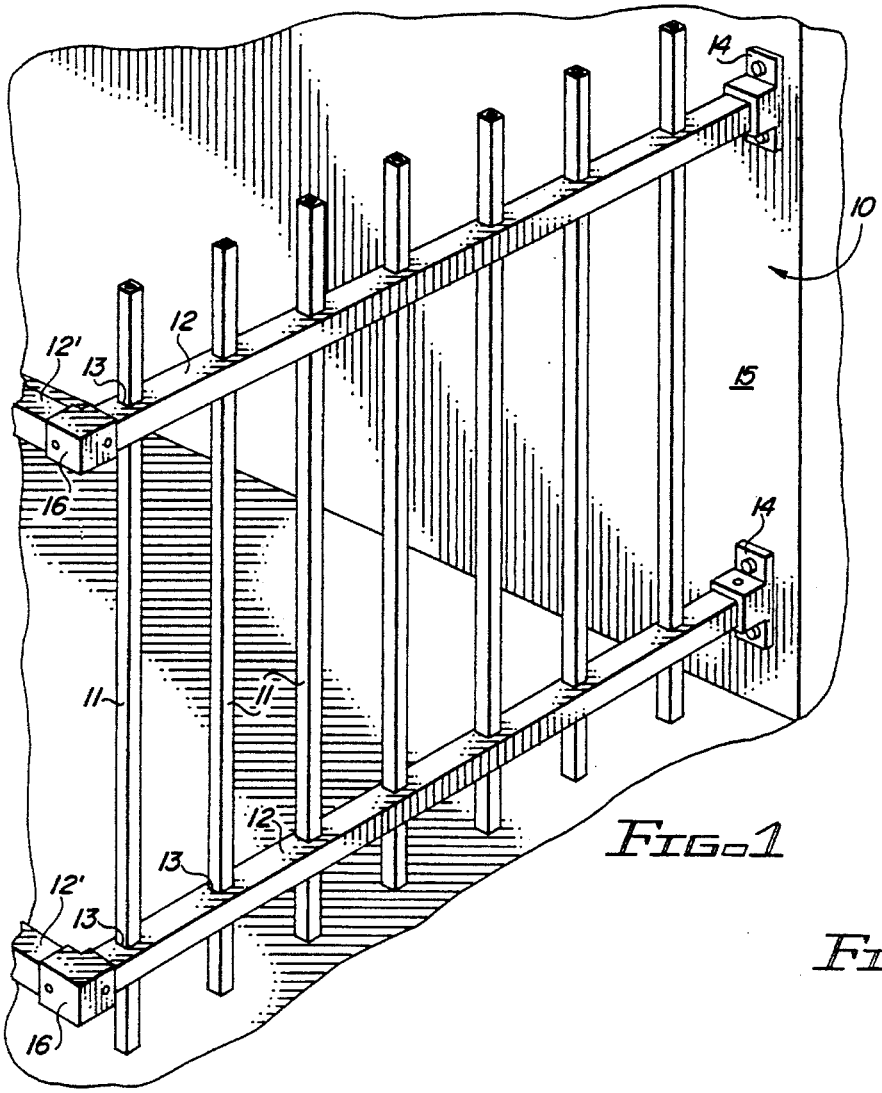
FIG. 1 is a perspective view of a portion of a fence comprising tubular metal poles and rails assembled and joined together in accordance with the teaching of the invention claimed herein.

Panel 10 comprises a grid of vertical multi-sided stakes, pickets or poles 11 supported by upper and lower multi-sided horizontal rails 12. The pickets and rails are preferably hollow metal tubular members formed of iron or aluminum with rectangular and preferably square cross sections with the rails typically having larger cross-sectional dimensions than the pickets or poles. As shown in FIG. 1, poles 11 pass through rectangular and preferably square clearance holes or apertures 13 in the rails.

Clearance holes 13 are centered in the horizontal top and bottom surfaces of rails 12 and are equally spaced along the lengths of the rails. Holes 13 are just large enough to receive poles 11 without interference, but snug enough to assure a rigid structure.

Panel 10 may be supported at the ends of rails 12 by means of suitable brackets 14 which secure the rails to posts or to a wall 15. At corners they may be secured at right angles to rails 12' of other panels by means of suitable brackets 16.

Figure 2:
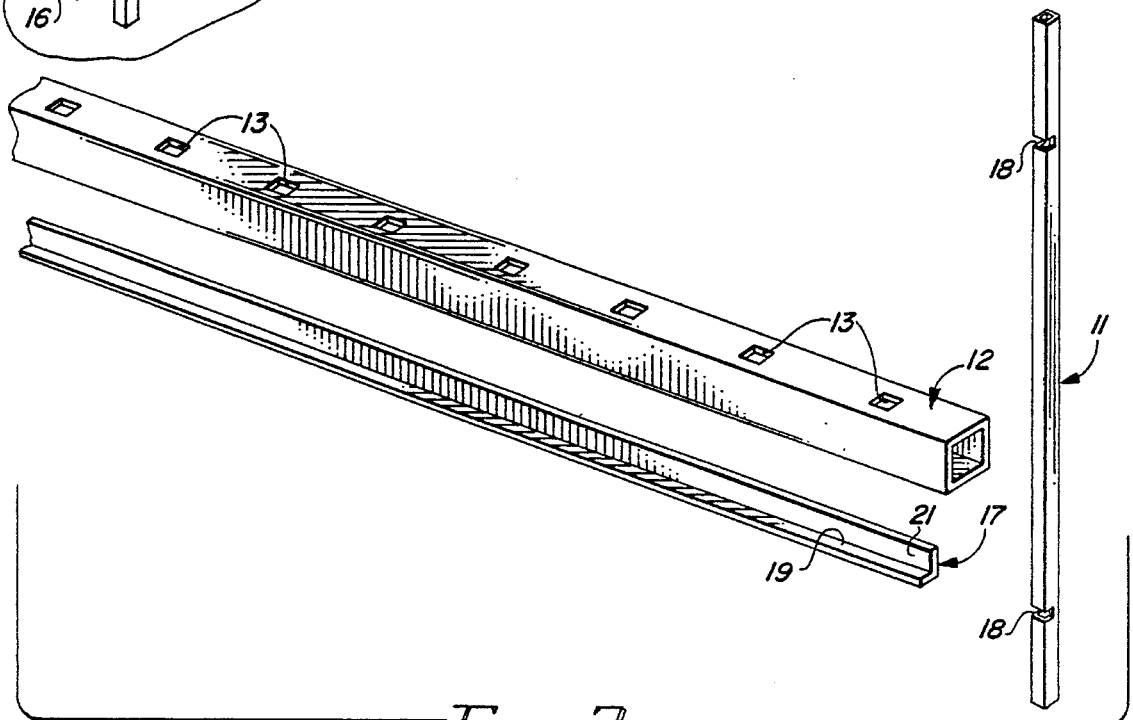
FIG. 2 is a perspective illustration of the component parts pertinent to the invention including the rails, the poles and the coupling bar.

The basic components of panel 10 are limited to three types as shown in FIG. 2, comprising rail 12, pole 11 and coupling bar 17.

As shown in FIG. 2, rail 12 is a tubular aluminum or steel bar with a rectangular and preferably square cross section. Its upper and lower walls are pierced by upper and lower pairs of aligned clearance holes 13 at regularly spaced intervals for receiving poles 11.

Poles 11 are also preferably tubular aluminum or steel bars with rectangular and preferably square cross sections. Each pole has two slots 18, one near each end of pole 11. Slots 18 are perpendicular to the flat face of the pole, extending approximately half way through the outside dimension of the pole from the flat surface.

Coupling bar 17 is preferably an aluminum or steel bar with an "L"-shaped cross section. The lower or horizontal leg 19 of the "L"-shaped cross section has a thickness dimension somewhat smaller than the width of slot 18 of pole 11 to permit relatively free passage therethrough during assembly. Vertical leg 21 of the "L"-shaped cross section has a length that is somewhat smaller than the inside dimension of tubular rail 12. The coupling bar is equal in length to the horizontal rail 12.

Panel 10, as illustrated FIG. 1, is seen to comprise two identical upper and lower rails 12 and a number of identical poles 11. Two identical coupling bars 17 complete the panel. The three types (rail 12, pole 11 and coupling bar 17) are very simple and inexpensive to manufacture. The rails, poles and coupling bars can readily be produced in a limited number of standard dimension to meet market demands. Rails and coupling bars may be cut to length as appropriate for a given installation.

Figure 3:
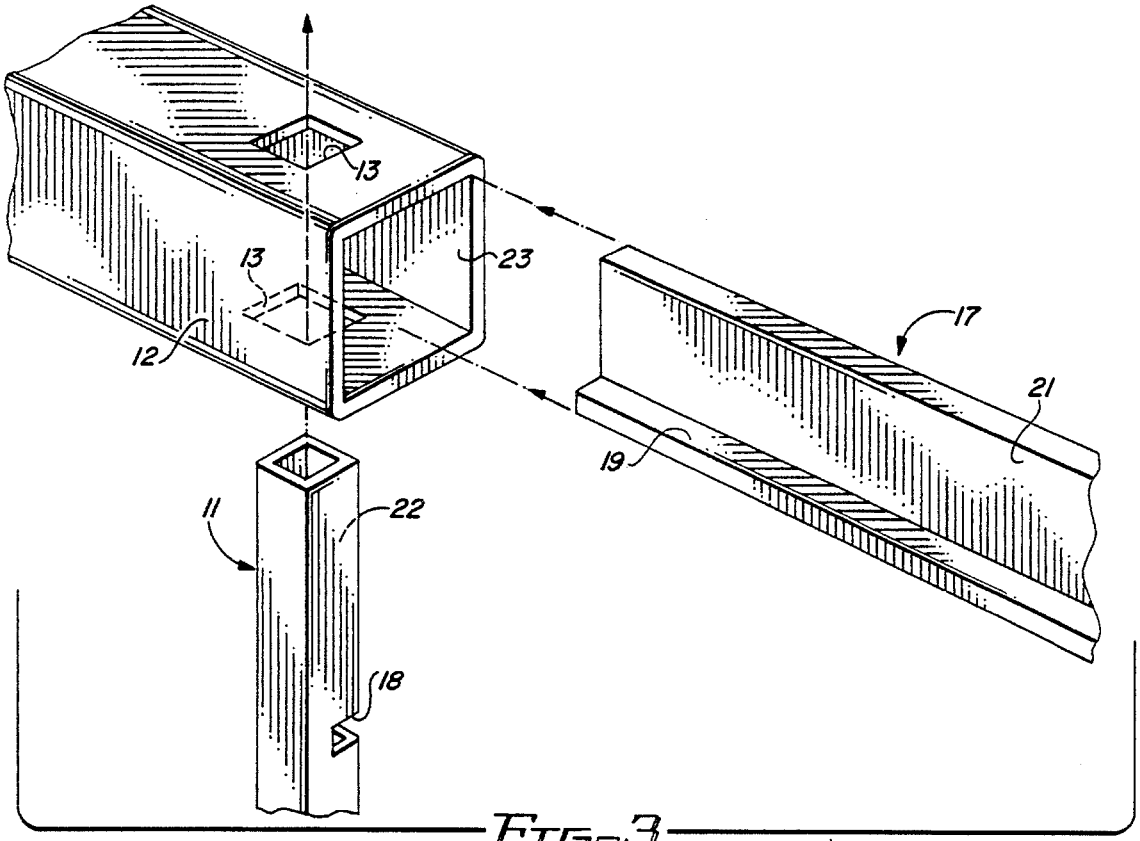
FIG. 3 is a partial perspective exploded view illustrating the assembly of the component parts.
Figure 4:
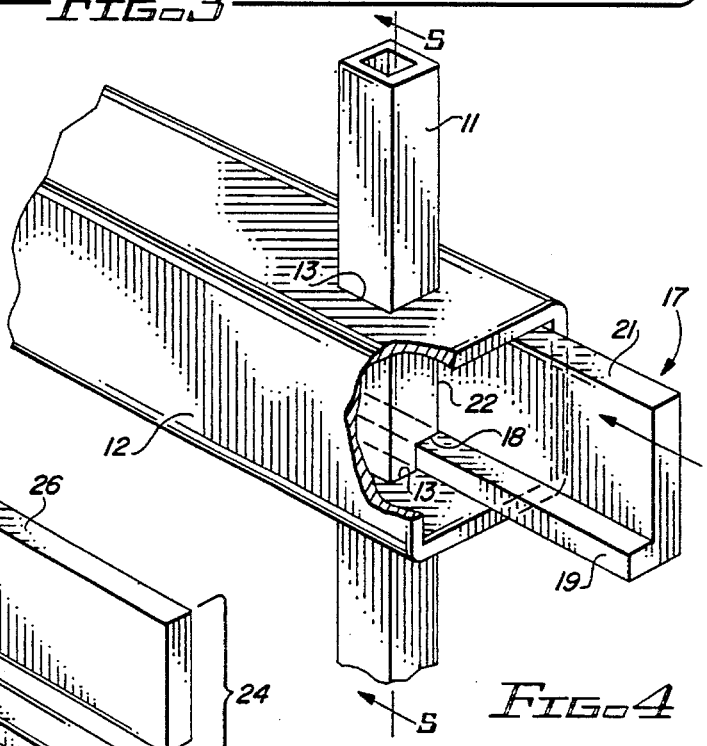
FIG. 4 is a partial perspective view illustrating the engagement of the slotted poles and the coupling bar.

The assembly of panel 10 is illustrated by the partial perspective views of FIGS. 3 and 4.

As shown in FIG. 3, the pole is first installed in rail 12 by passing the end of the pole through the upper and lower holes 13 of rail 12. The end of coupling bar 17 is then inserted into the open end of rail 12 with lower leg 19 of its "L"-shaped cross section passing through slot 18 of pole 11 and with its vertical leg 21 passing through the opening between one side 22 of pole 11 and the adjacent inside wall 23 of rail 12.

Figure 5:
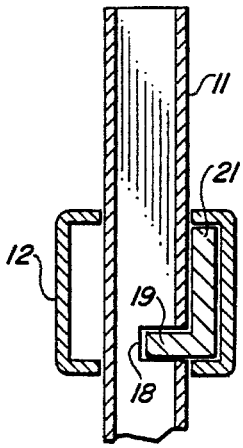
FIG. 5 is a cross-sectional view of FIG. 4 taken along line 5—5.

As the installation is completed as shown in FIG. 4 and as further illustrated in the cross sectional view of FIG. 5, pole 11 is secured against horizontal motion relative to rail 12 by the periphery of holes 13, and pole 11 is secured against vertical motion by the engagement of slot 18 with coupler bar 17. Bar 17, in turn, is securely confined within rail 12.

Figure 7:
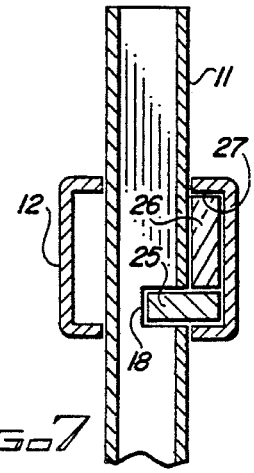
FIG. 7 is a cross-sectional view showing the engagement of the slotted pole and the second embodiment of the coupling bar.
Figure 6:
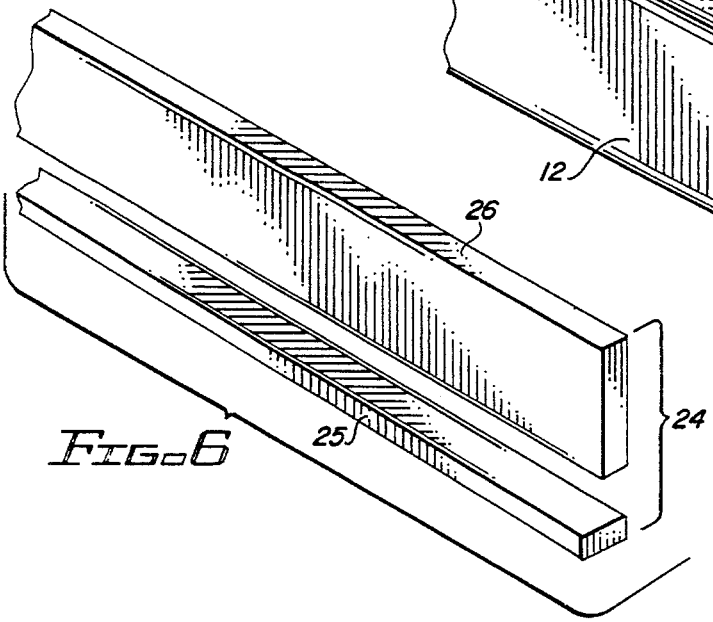
FIG. 6 is a perspective view showing a second embodiment of the coupling bar.

In the alternate construction of FIGS. 6 and 7, coupling bar 17 of FIGS. 3–5 is replaced by a two-piece coupling mechanism 24. Mechanism 24 comprises two elongated rectangular strips including a key strip 25 and a wedge strip 26. Key strip 25 replaces lower leg 19 of bar 17 while wedge strip 26 replaces vertical leg 21. As shown in FIG. 7, key strip 25 engages slot 18 of pole 11, and wedge strip 26 is wedged between the upper surface of key strip 26 and an opposing inside wall 27 of rail 12. Wedge strip 26 secures key strip in position within slot 18 and prevents vertical displacement of strip 26 relative to rail 12.

A new fence construction together with a simple and effective means for joining its components parts is thus provided in accordance with the stated objects of the invention, and although but a single embodiment of the invention has been illustrated and described, it will be apparent to those skilled in the art that various changes and modifications may be made therein without departing from the spirit of the invention or from the scope of the appended claims.

What is claimed is:

1. A panel for fence and grating uses comprising:

at least a pair of spaced four-sided tubular metallic rails parallelly arranged for fence and grating purposes, each of said rails being provided with a like number of similarly spaced four-sided apertures extending through said rails substantially at right angles to and centered on the longitudinal axis of said rails, a plurality of four-sided tubular metallic pickets each having outside dimensions substantially corresponding to the dimensions of said apertures and extending snugly through respective aligned apertures in each of said rails to form with said rails a panel, said outside dimensions of said pickets being sufficiently smaller than the inside dimensions of said tubular rails as to provide a transverse space between a first side of each picket and an opposed interior side of each tubular rail, said pickets each having at locations along its length corresponding to the positions of said rails a slot extending into a common face of said first side of said pickets perpendicular to the longitudinal axis of said picket, and fastening means comprising elongated coupling bar means slidably fitted within said transverse space and extending through each said rail and engaging a respective slot in each of said pickets and said opposed interior side of said tubular rail for firmly holding said rails to said pickets to form a rigid structure.

2. The panel set forth in claim 1 wherein:

said coupling bar means has an L-shaped cross-section having short and long legs, the short leg of which is urged into the common slot of each of said pickets by engagement of its long leg with said opposed interior side of said tubular rail.

3. The panel set forth in claim 1 wherein:

said coupling bar means comprises an elongated thin flat strip of rectangular cross-section slidably fitted within and extending longitudinally through said rail and through a respective slot in each of said pickets, and an elongated thin flat wedge slidably fitted within said transverse space and extending longitudinally through said rail between said strip and said opposed interior side of said rail for retaining said strip in said respective slot of each of said pickets and locking said rails to said pickets.

4. A panel for fence and grating uses comprising:

upper and lower four-sided tubular metallic rails each having a plurality of four-sided through-apertures therein centered on its longitudinal axis, a plurality of vertically disposed four-sided tubular metallic pickets arranged in mutually parallel relationship between said rails and extending snugly through respectively aligned ones of said through-apertures in said rails, the outside dimensions of said pickets being sufficiently smaller than the inside dimensions of said tubular rails as to provide a transverse space between a common side of said plurality of pickets and an opposed interior side of a respective rail, said pickets each having at locations along its length corresponding to the positions thereon of said upper and lower rails a respective slot extending into a face of said common side of said pickets perpendicularly to the longitudinal axis of the picket, and locking means, one for each of said upper and lower rails, each comprising elongated coupling bar means slidably fitted within said transverse space and extending longitudinally along the length of said rail for engaging a respective slot in each of said pickets and said opposed interior side of said tubular rail and firmly locking said rail to said pickets to form a rigid structure.

* * * * *